US012116195B2

(12) United States Patent
Spadavecchia et al.

(10) Patent No.: US 12,116,195 B2
(45) Date of Patent: Oct. 15, 2024

(54) WATER DISPENSER TRANSPORT PALLET ASSEMBLY

(71) Applicant: Polymer Solutions International Inc., Medford, NJ (US)

(72) Inventors: John Spadavecchia, Lynchburg, VA (US); Steve Kurth, Muskego, WI (US); Jeffery Jacobs, Lexington, SC (US)

(73) Assignee: Polymer Solutions International, Inc., Medford, NJ (US)

( * ) Notice: Subject to any disclaimer, the term of this patent is extended or adjusted under 35 U.S.C. 154(b) by 0 days.

(21) Appl. No.: 17/025,614

(22) Filed: Sep. 18, 2020

(65) Prior Publication Data

US 2021/0078781 A1 Mar. 18, 2021

Related U.S. Application Data

(60) Provisional application No. 62/947,696, filed on Dec. 13, 2019, provisional application No. 62/901,874, filed on Sep. 18, 2019.

(51) Int. Cl.

| | |
|---|---|
| ***B65D 71/00*** | (2006.01) |
| ***B65D 19/06*** | (2006.01) |
| ***B65D 19/44*** | (2006.01) |

(52) U.S. Cl.

CPC ..... *B65D 71/0096* (2013.01); *B65D 19/06* (2013.01); *B65D 19/44* (2013.01); *B65D 2519/00273* (2013.01); *B65D 2519/00348* (2013.01); *B65D 2519/00815* (2013.01); *B65D 2571/00067* (2013.01)

(58) Field of Classification Search

CPC ..... B65D 19/00; B65D 19/06; B65D 19/26; B65D 19/31; B65D 19/32; B65D 19/38; B65D 19/40; B65D 19/44; B65D 71/00; B65D 71/0096; B65D 2519/00273; B65D 2519/00348; B65D 2519/00815; B65D 2571/00067

USPC ..... 206/386, 598, 600; 220/4.21, 4.24, 507, 220/513

See application file for complete search history.

(56) References Cited

U.S. PATENT DOCUMENTS 4,254,873 A * 3/1981 Cook, III ..... B65D 19/00 108/55.3
4,266,407 A * 5/1981 Gibson ..... F25D 3/08 206/545
4,480,748 A * 11/1984 Wind ..... B65D 71/0096 108/55.3

(Continued)

FOREIGN PATENT DOCUMENTS

JP 07277366 A * 10/1995

*Primary Examiner* — Bryon P Gehman
(74) *Attorney, Agent, or Firm* — Buchanan Ingersoll & Rooney PC

(57) ABSTRACT

A dispenser transport pallet assembly for transporting a dispenser having a given configuration. The assembly includes a base member having a body with a lower surface and an upper surface. A plurality of rail members extend upward from the upper surface to define a plurality of lower cavities. A top cap has a cover surface with a plurality of rail members extending downward from an inner surface thereof to define a plurality of upper cavities. Each of the upper cavities is aligned with a respective lower cavity and each pair of upper and lower cavities is configured to receive and retain a respective dispenser.

8 Claims, 13 Drawing Sheets

(56) References Cited

U.S. PATENT DOCUMENTS

| | | | | | |
|---|---|---|---|---|---|
| 4,481,792 | A * | 11/1984 | Groeger | B65D 81/3827 | 62/457.5 |
| 4,763,787 | A * | 8/1988 | Koenig | B65D 85/42 | 206/821 |
| 5,201,421 | A * | 4/1993 | Maier | B65D 19/44 | 229/120.31 |
| 5,407,078 | A * | 4/1995 | Strauser | B65D 71/0092 | 206/326 |
| 6,135,287 | A * | 10/2000 | Hartwall | B65D 19/18 | 206/600 |
| 6,227,370 | B1 * | 5/2001 | Earnshaw | B65D 71/0096 | 206/509 |
| 9,156,586 | B2 * | 10/2015 | Girsh | B65D 19/44 | |
| 9,828,166 | B2 * | 11/2017 | Bouffand | B65D 71/0096 | |
| 2003/0052131 | A1 * | 3/2003 | Jensen | B65D 25/04 | 220/528 |
| 2006/0254476 | A1 * | 11/2006 | MacDonald | B65D 19/0038 | 108/53.3 |
| 2009/0266782 | A1 * | 10/2009 | Lane | B65D 71/0096 | 215/10 |
| 2010/0059406 | A1 * | 3/2010 | Ng | B65D 19/18 | 108/51.11 |

* cited by examiner

WATER DISPENSER TRANSPORT PALLET ASSEMBLY

This application claims the benefit of U.S. Prov. Appln. No. 62/901,874, filed on Sep. 18, 2019, and U.S. Prov. Appln. No. 62/947,696, filed on Dec. 13, 2019, the contents of each of which are incorporated by reference.

FIELD OF THE INVENTION

This invention relates to transport of bottled water dispensers. More particularly, the invention relates to a pallet assembly configured to store and protect water dispensers during transport.

BACKGROUND OF THE INVENTION

Bottled water dispensers are commonly referred to as a water dispenser or a water cooler. Most water dispensers 10 work by having a 3, 4 or 5-gallon water bottle upside down on the top of the dispenser housing 12 (see FIG. 1). This allows gravity and vacuum pressure to do the job of filling a glass when someone presses one of the dispense buttons 14. When this happens, air is allowed into the bottle so water can escape into your glass or bottle. The bottled water dispenser 10 may have various components within the housing 12, for example, a tank (or two) to store the water to be heated or cooled prior to dispensing, a water heater to heat the water, a refrigerating system to cool the water.

Dispenser storage and transport is a common occurrence. Not only are dispensers issued/rented/sold to new customers, used dispensers are continually brought back to the bottlers for repair and refurbishment. In many instances, the dispensers are simply positioned in an empty cargo area of a delivery truck. Such transport leaves the dispensers subject to movement, bouncing, falling and the like. The dispensers are surprisingly delicate. During transport and storage, the dispensers are easily damaged.

Referring to FIGS. 1 and 2, some attempts have been made to minimize movement of the dispensers 10 by positioning them within an enclosed area 42 of a case good rack 40. The case good rack 40 generally includes a fixed frame structure 44 secured to a pallet 46. A pivotal member 48 may be utilized to close the enclosed area 42 during transport. In the embodiment illustrated in FIG. 1, the dispensers 10 are positioned within plastic bags 15 and in the embodiment of FIG. 2, the dispensers 10 are positioned within cardboard boxes 17. Even though the dispensers 10 are positioned within an enclosed area 42 and wrapped in either plastic or cardboard, the dispensers 10 are still subject to movement and bouncing and prone to damage.

SUMMARY OF THE INVENTION

In at least one embodiment, the present invention provides a dispenser transport pallet assembly for transporting a dispenser having a given configuration. The assembly includes a base member having a body with a lower surface and an upper surface. A plurality of rail members extend upward from the upper surface to define a plurality of lower cavities. A top cap has a cover surface with a plurality of rail members extending downward from an inner surface thereof to define a plurality of upper cavities. Each of the upper cavities is aligned with a respective lower cavity and each pair of upper and lower cavities is configured to receive and retain a respective dispenser.

In at least one embodiment, a perimeter rail extends upward from the base member upper surface and a perimeter rail extends downward from the top cap cover surface. The perimeter rails define at least a portion of some of the upper and lower cavities. Additionally, the perimeter rails define a perimeter gap configured to receive a sleeve extending between the base member and the top cap.

In at least one embodiment, the present invention provides a dispenser transport pallet assembly for transporting a plurality of dispensers. The assembly includes a base member defining a support surface. A wall assembly is supported by the base member and defines a plurality of dispenser chambers. A top cap is supported by the wall assembly.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
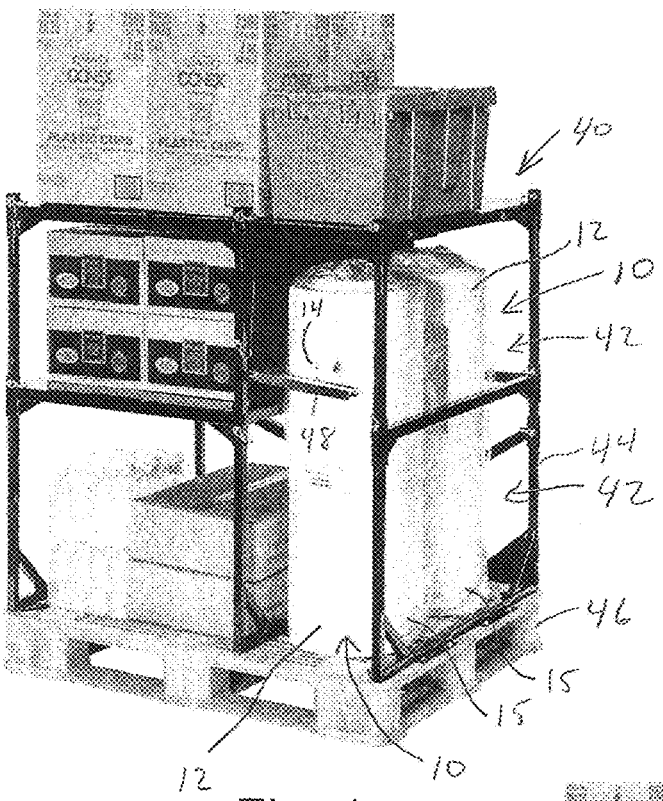
Fig. 1 (PRIOR ART)
FIG. 1 is a perspective view of a pair of water dispensers positioned for transport on a prior art case good rack.
Figure 2:
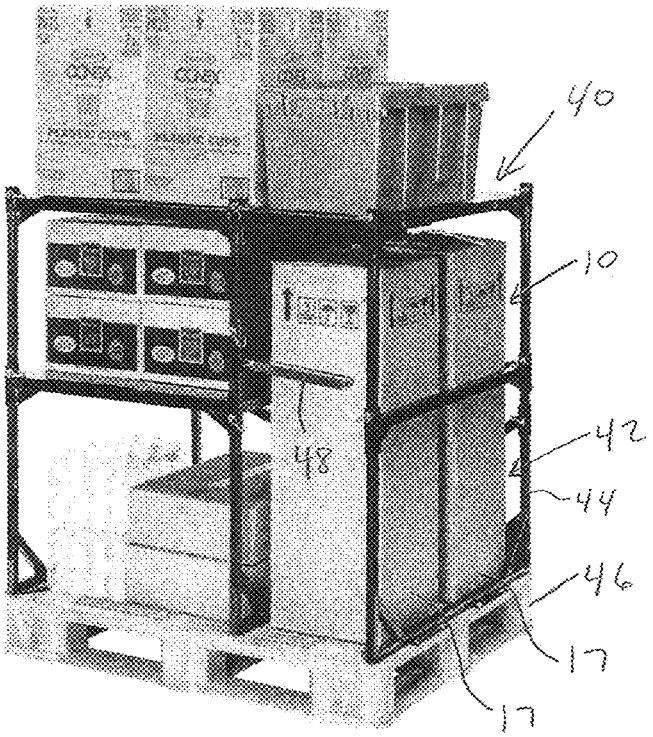
Fig. 2 (PRIOR ART)
FIG. 2 is a perspective view of another pair of water dispensers positioned for transport on a prior art case good rack.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 3:
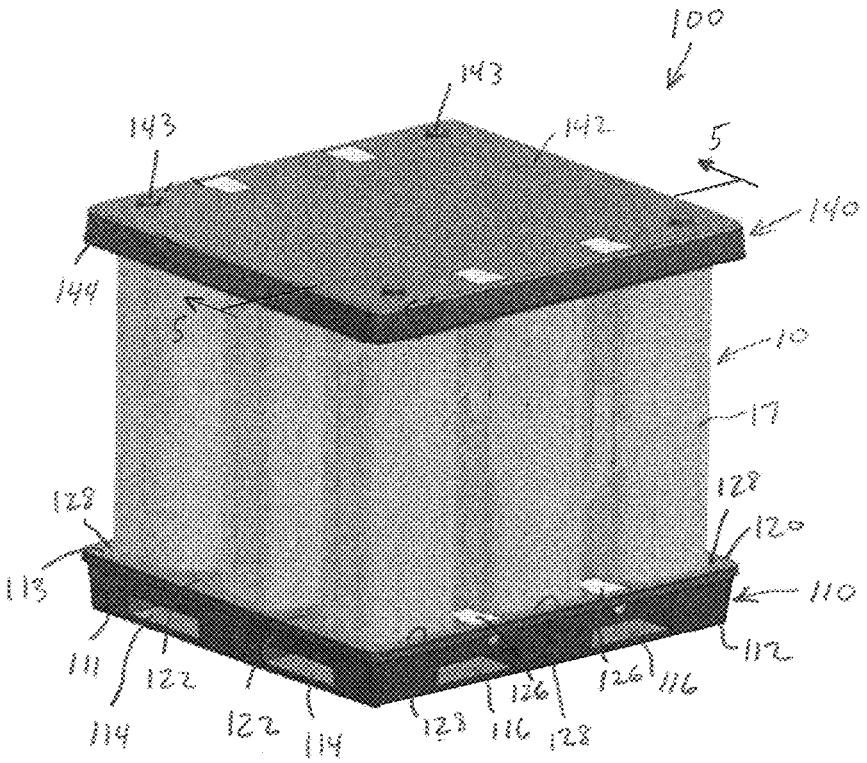
FIG. 3 is a perspective view of a dispenser transport pallet assembly in accordance with an embodiment of the invention.
Figure 4:
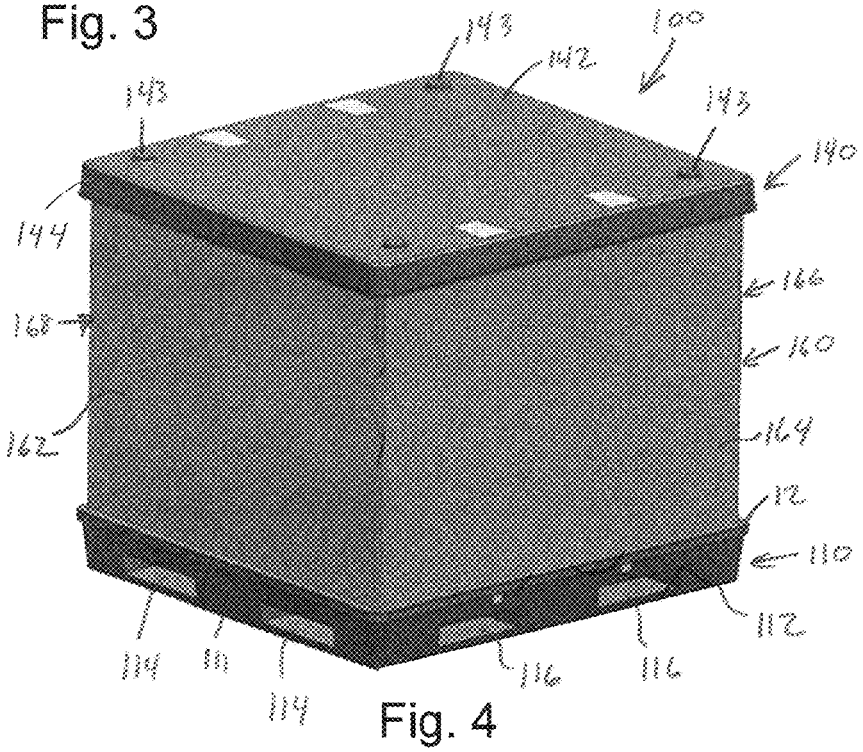
FIG. 4 is a perspective view of the dispenser transport pallet assembly of FIG. 3 with an optional sleeve positioned thereon.

Referring to FIGS. 3-7, an exemplary embodiment of a dispenser transport pallet assembly 100 in accordance with an embodiment of the invention will be described. The pallet assembly 100 generally includes a base member 110 and a top cover 140. An optional sleeve 160 may be positioned between the base member 110 and the top cover 140 as shown in FIG. 4. The base member 110 defines a plurality of dispenser lower cavities 128 while the top cap 140 defines a plurality of upper cavities 148. Each of the upper cavities 148 is aligned with a respective lower cavity 128 such that a dispenser 10 is positioned with its lower portion in a lower cavity 128 and its upper portion in an upper cavity 148, thereby securing each dispenser in a position spaced from the outer perimeter and away from one another.

Figure 5:
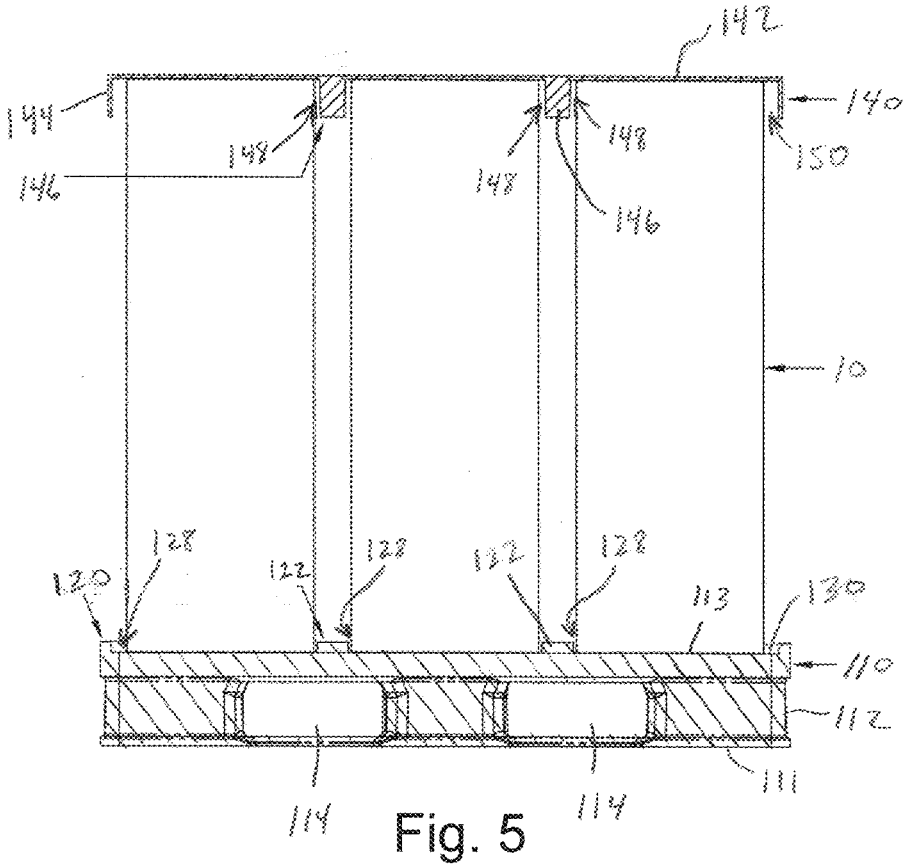
FIG. 5 is a cross-sectional view along the line 5-5 in FIG. 3.
Figure 6:
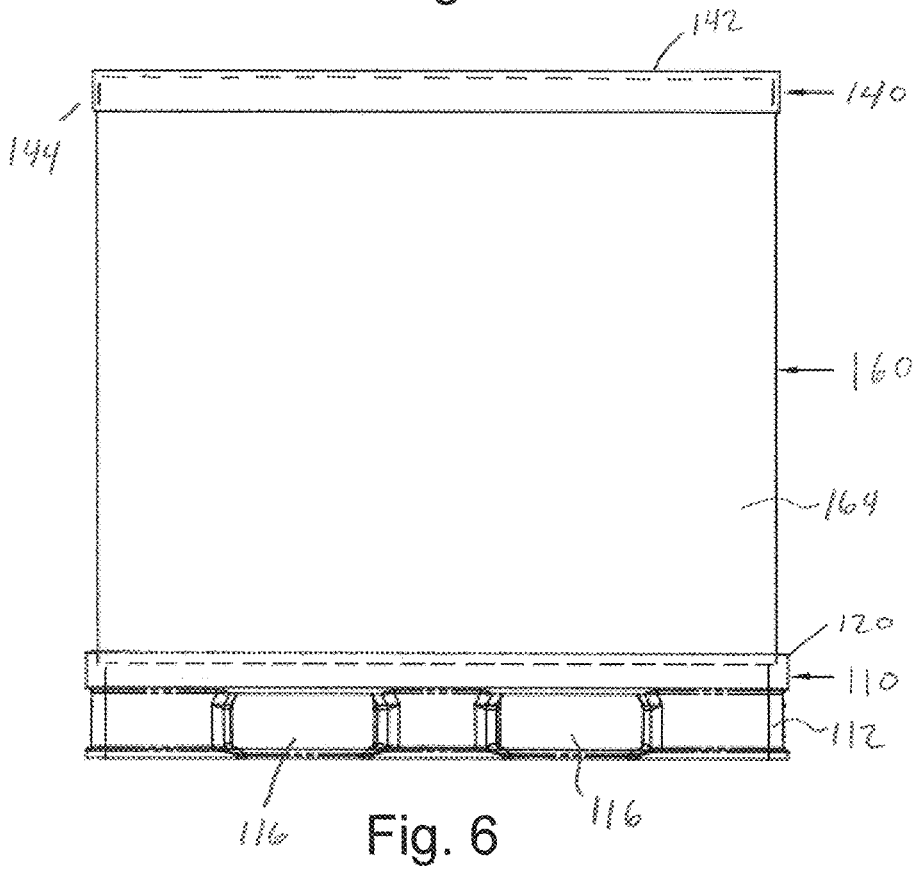
FIG. 6 is a front elevation view of the dispenser transport pallet assembly of FIG. 4.
Figure 7:
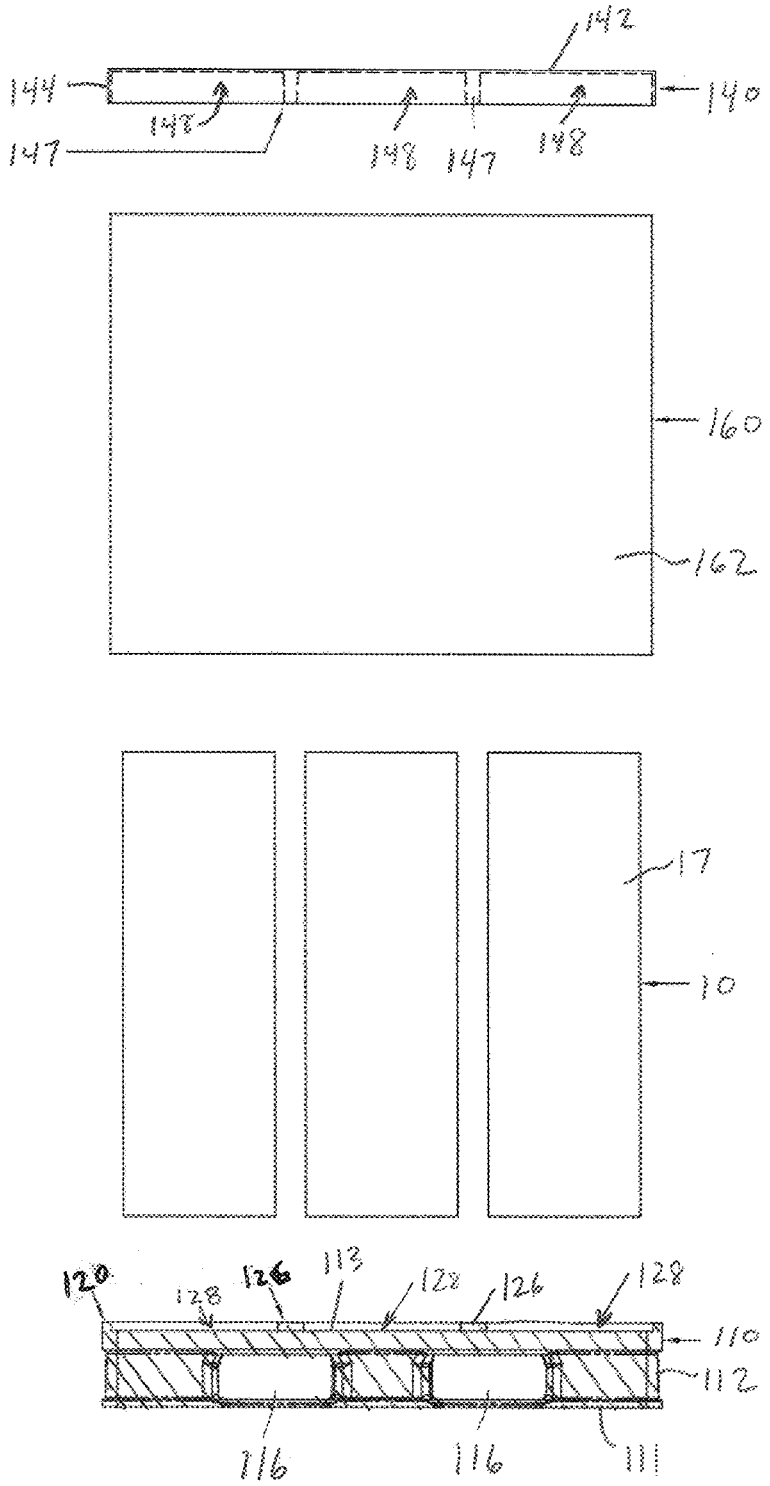
FIG. 7 is an exploded side elevation view of the dispenser transport pallet assembly of FIG. 3.

The base member 110 includes a pallet body 112 extending from a lower surface 111 to an upper surface 113. In the illustrated embodiment, a pair of fork openings 114 extend from front to back while a pair of fork openings 116 extend from side to side through the pallet body 112. A rim 120 extends up from the pallet upper surface 113 around the perimeter thereof. The rim 120 may be continuous as illustrated or may extend at intervals along a portion of each lower cavity 128. To further define the lower cavities 128, longitudinal rails 122 extend from the pallet upper surface 113 from front to back while lateral rails 126 extend from the pallet upper surface 113 from side to side. The rails 122, 126 may have linear and/or curved configurations to define the desired shape of each cavity 128. The rails 122, 126 may be continuous as illustrated or may extend at intervals along a portion of each lower cavity 128. The cavities 128 preferably have a configuration which complements the configuration of each dispenser 10. In the illustrated embodiment, each dispenser 10 is positioned in a rectangular cardboard box 17 and each cavity 128 has a corresponding configuration. Referring to FIG. 5, the rim 120 may be configured such that a gap 130 remains between rim 120 and the position of the dispensers 10 such that the optional sleeve 160 may be received in the gap 130 as will be described hereinafter.

The top cap 140 includes a cover surface 142 with a rim 144 extending downwardly from the perimeter thereof. The rim 144 may be continuous as illustrated or may extend at intervals along a portion of each upper cavity 148. To further define the upper cavities 148, longitudinal rails 146 extend from the inside surface of the cover surface 142 from front to back while lateral rails 147 extend from the inside surface of the cover surface 142 from side to side. The rails 146, 147 may have linear and/or curved configurations to define the desired shape of each cavity 148. The rails 146, 147 may be continuous as illustrated or may extend at intervals along a portion of each upper cavity 148. The cavities 148 preferably have a configuration which complements the configuration of each dispenser 10 and are each aligned with a corresponding lower cavity 128. The cavities 128, 148 may engage the outside of the dispensers or may engage features within the perimeter of the respective dispenser, for example, the framework of an open bottom or the inside of the opening that receives the bottles. In the illustrated embodiment, each dispenser 10 is positioned in a rectangular cardboard box 17 and each cavity 148 has a corresponding configuration. Referring to FIG. 5, the rim 140 may be configured such that a gap 150 remains between rim 144 and the position of the dispensers 10 such that the optional sleeve 160 may be received in the gap 150 as will be described hereinafter. Referring to FIGS. 3 and 4, projections 143 may extend from the cover surface 142. The projections 143 are configured to engage within detents (not shown) on the bottom of the base member 110 if units are stacked on top of one another.

Figure 8:
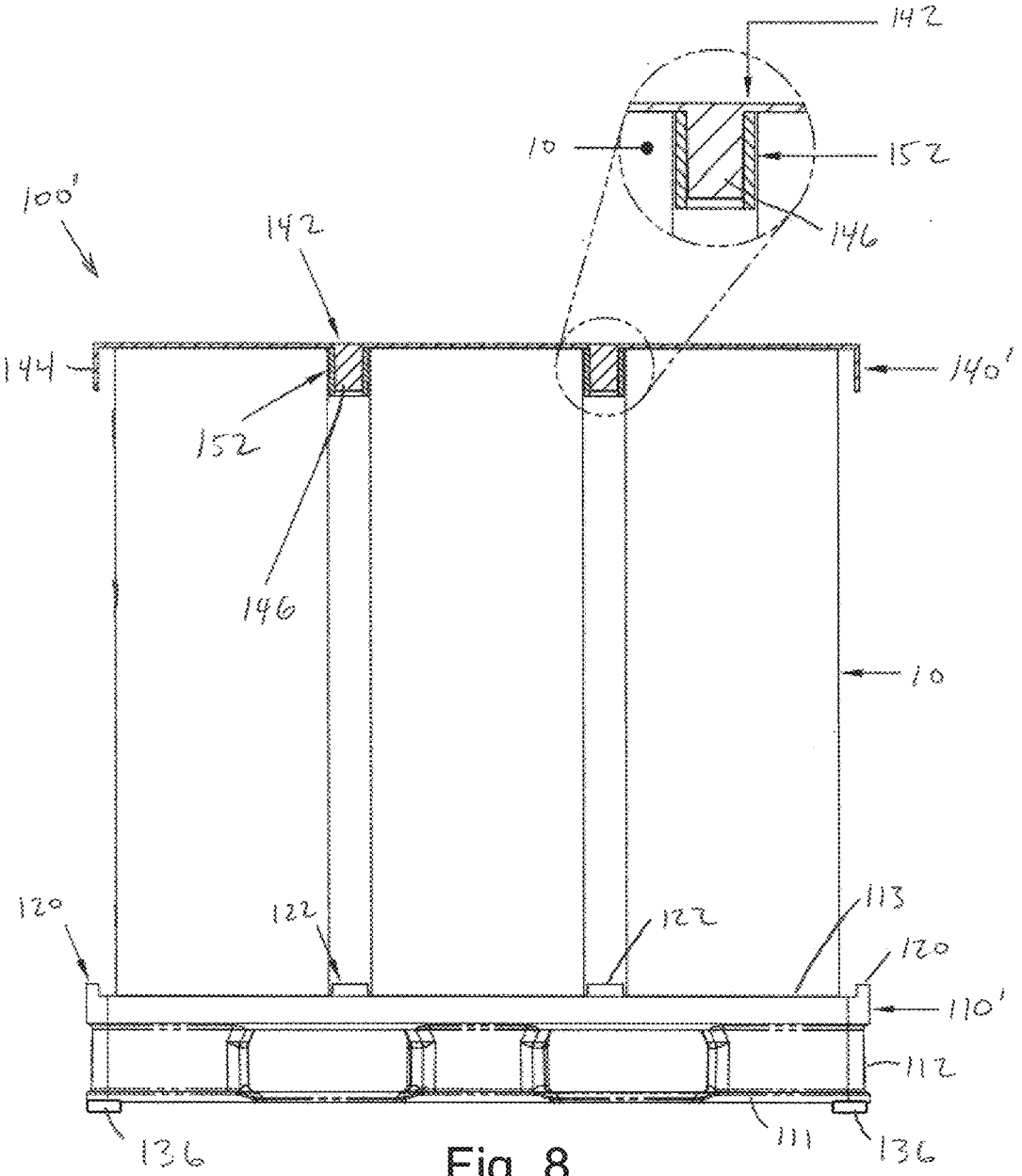
FIG. 8 is a front elevation view, in partial section, of a dispenser transport pallet assembly in accordance with another embodiment of the invention.

Referring to FIG. 8, a dispenser transport pallet assembly 100' in accordance with another embodiment of the invention is shown. The present embodiment is substantially the same as the previous embodiment and only the differences will be described. In the present embodiment, each of the upper rails 146, 147 of the top cap 140' is formed with pads 152 produced from a lower durometer material that provide greater cushioning of the dispensers. While shown on the upper rails 146, 147, the pads 152 may additionally or alternatively be provided on the lower rails 122, 126. The pads 152 may be over molded or mechanically attached directly to the rails 122, 126, 146, 147. As an alternative, the rails may be formed separately from the pallet or the top cap, with or without the pads, and then attached to the pallet or the cap. Mechanically attaching pads and/or rails would allow for customization for specific dispensers.

Figure 9:
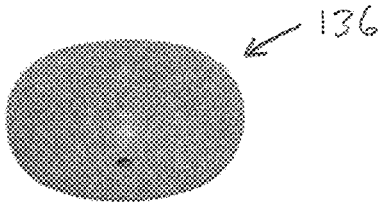
FIG. 9 is a perspective view of a shock dampener of the dispenser transport pallet assembly of FIG. 8.
Figure 10:
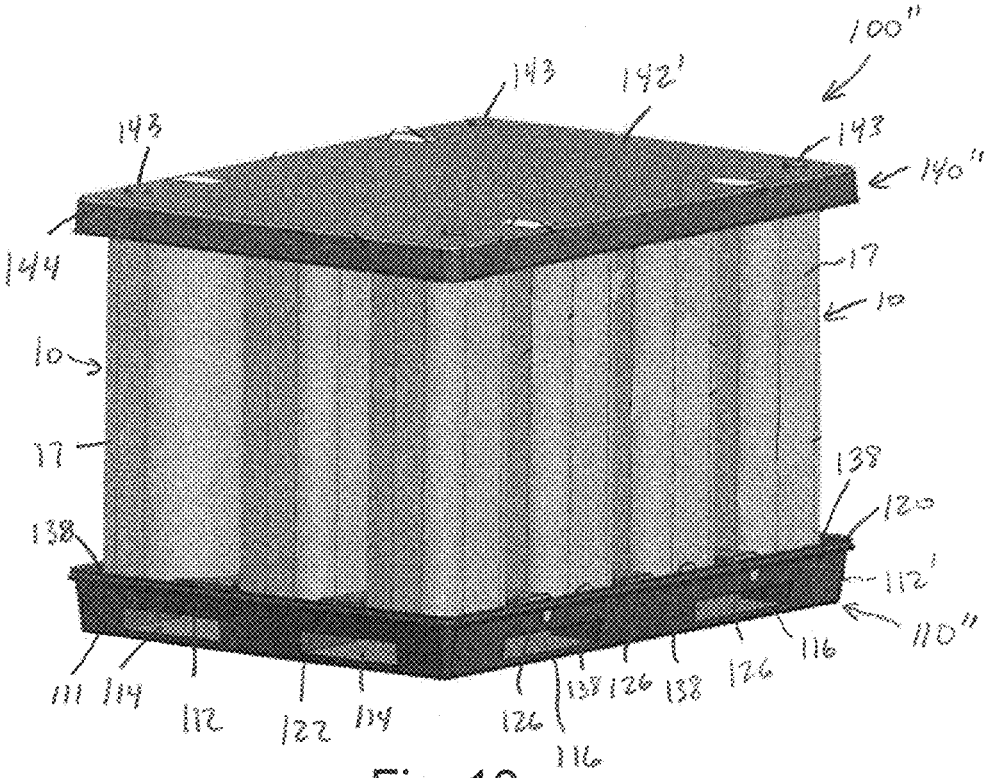
FIG. 10 is a perspective view of a dispenser transport pallet assembly in accordance with another embodiment of the invention.
Figure 11:
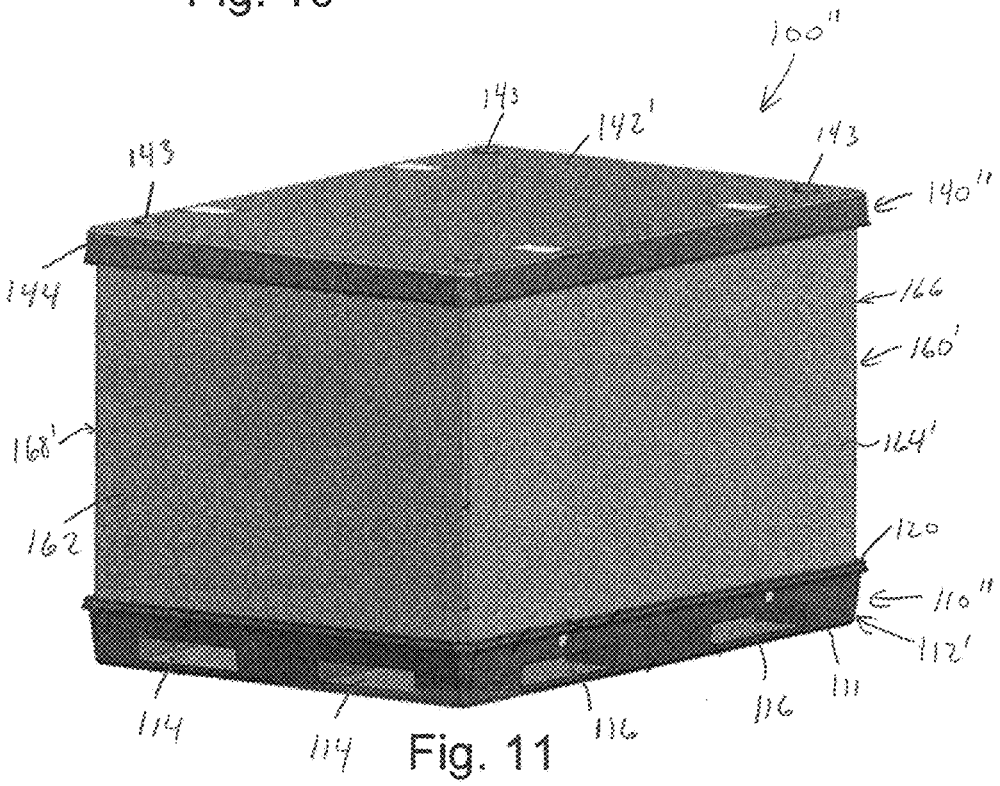
FIG. 11 is a perspective view of the dispenser transport pallet assembly of FIG. 10 with an optional sleeve positioned thereon.
Figure 12:
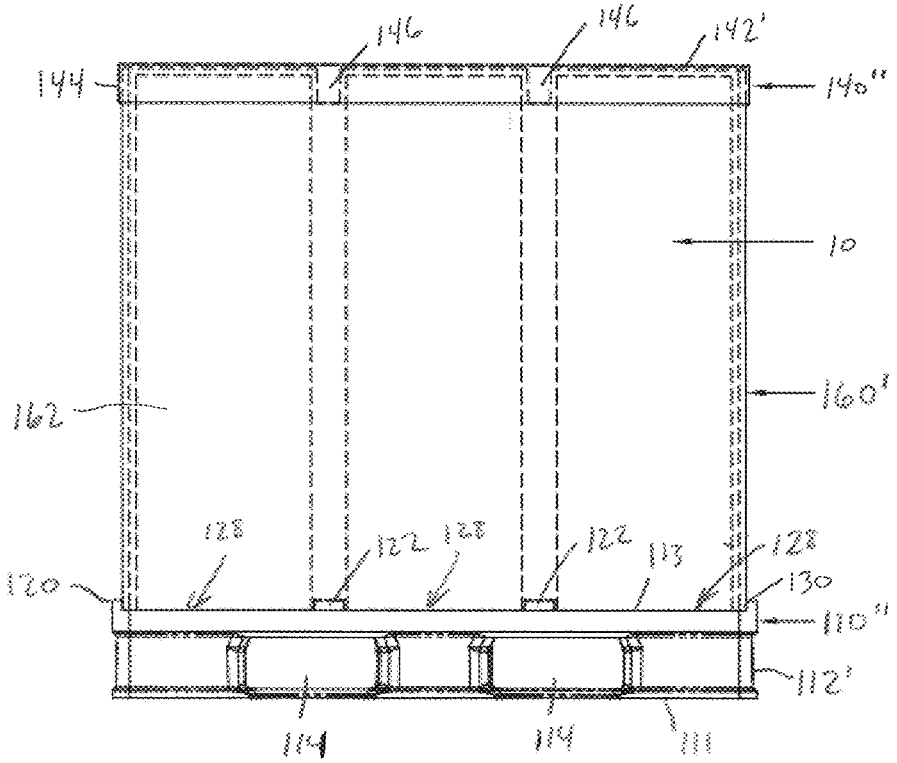
FIG. 12 is a front elevational view of the dispenser transport pallet assembly of FIG. 10.
Figure 13:
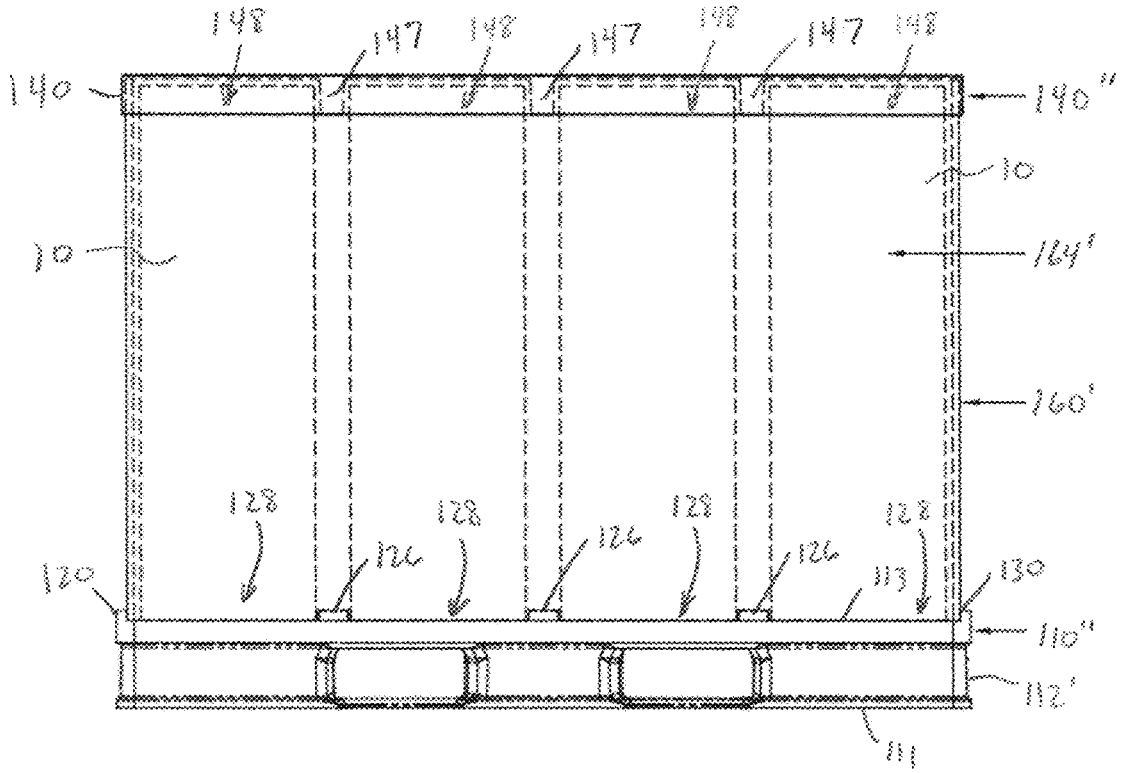
FIG. 13 is a side elevation view of the dispenser transport pallet assembly of FIG. 10.

The pallet assembly 100' illustrated in FIG. 8 also includes a plurality of shock dampeners 136 attached to the lower surface 111 of the base member 110'. The shock dampeners 136 extend between the base member 110' and the surface on which the assembly 100' is placed to reduce vibration of the base member 110' and thereby the dispensers 10 positioned in the pallet assembly 100'. The illustrated shock dampener 136, shown in FIG. 9, is an elastomeric ring filled with air, however, other dampener structures may be utilized. For example, the dampener may be filled with other fluids, for example, liquids or gels. Additionally, the dampener may be sealed with a fixed amount of fluid or may be fillable to include any desired amount of fluid. As yet another alternative, the dampener may have a solid structure, for example, a rubber or elastomeric foam structure.

Referring to FIGS. 4-7, an optional sleeve 160 may be positioned between the base member 110 and the top cap 140. The sleeve 160 includes a plurality of interconnected panels 162, 164, 166, 168, each configured to extend along a respective side of the base member 110. The sleeve 160 is positioned such that it sits in the gaps 130, 150 and extends about the dispensers 10. The sleeve 160 will provide further protection from impact, scratching and dirt. In the illustrated embodiment, the sleeve panels 162-168 have a linear configuration, however, the panels 162-168 may have features which engage the dispensers 10 around the perimeter. For example, the panels 162-168 may have a corrugated configuration such that inside surfaces of the wavy structure contact and protect the dispensers. Additionally or alternatively, protective pads made from a lower durometer material (not shown) may be provided along the inside surfaces of the sleeve 160.

Referring to FIGS. 10-13, a dispenser transport pallet assembly 100" in accordance with another embodiment of the invention will be described. While the pallet assembly 100 of the previous embodiments is configured to transport nine dispensers 10, the pallet assembly 100" is configured to transport twelve dispensers 10. In this regard, the base member 110" has a body 112' having a larger width and includes three lateral rails 126 instead of two as in the previous embodiment. Similarly, the top cap 140" has a cover surface 142' having a larger width and includes three lateral rails 147 instead of two as in the previous embodiment. The sleeve 160' has a corresponding configuration with the panels 164', 168' having a larger width to complement that of the base member 110" and top cap 140". In other respects, the pallet assembly 100" is the same as in the previous embodiments. While pallet assemblies configured to retain nine or twelve dispensers are described and illustrated, it is understood that they may be configured to retain more or fewer dispensers.

Figure 14:
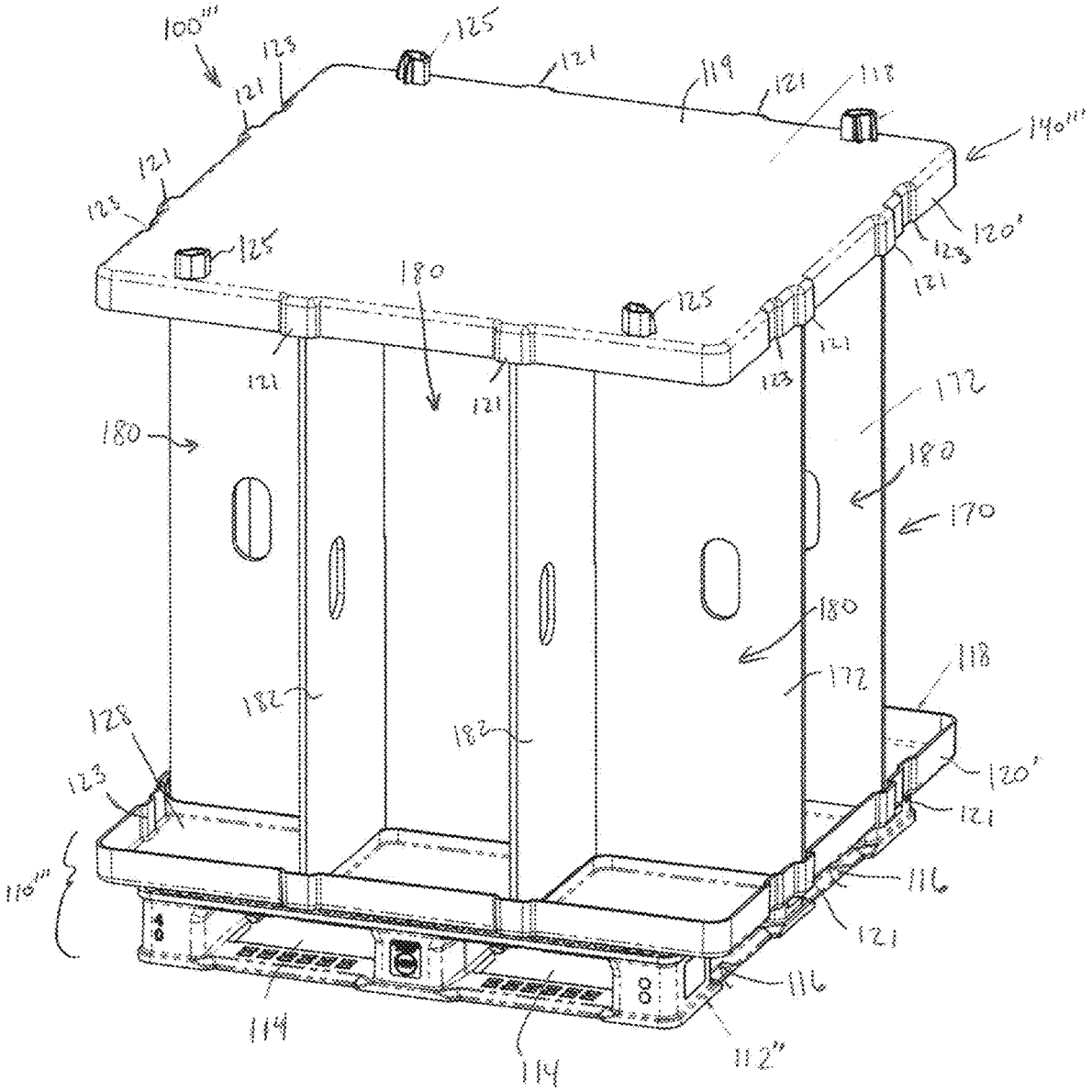
FIG. 14 is a perspective view of a dispenser transport pallet assembly in accordance with another embodiment of the invention.

Referring to FIGS. 14-20, an exemplary embodiment of a dispenser transport pallet assembly 100'" in accordance with another embodiment of the invention will be described. The pallet assembly 100'" generally includes a base member 110'" and a top cover 140". In the present embodiment, the base member 110'" is defined by a tray member 118 removably supported on a pallet body 112" and the top cover 140'" is defined by a tray member 118 also. An optional wall assembly 170 may be positioned between the base member 110'" and the top cover 140'" as shown in FIG. 14. The pallet body 112" may various configurations and extends from a lower surface 111 to an upper surface 113'. A plurality of post receiving holes 115 extend through the pallet body 112" from the upper surface 113' to the lower surface 111' (see FIG. 15). The holes 115 are positioned and configured to receive posts extending from the tray members 118, as explained below. A pair of fork openings 114 extend from front to back while a pair of fork openings 116 extend from side to side through the pallet body 112".

Figure 22:
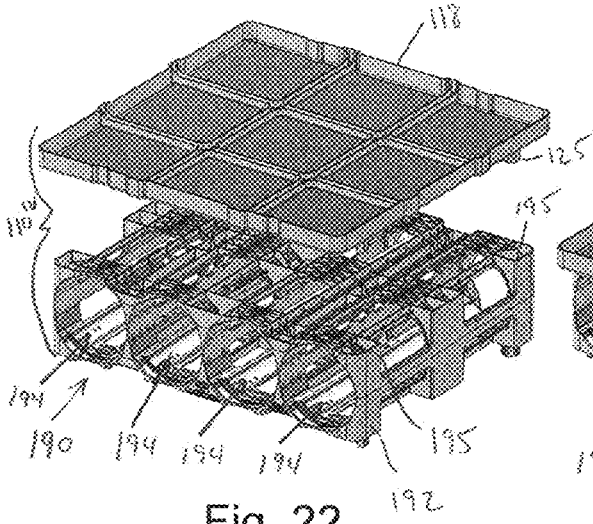
FIG. 22 is an exploded perspective view of a base member in accordance with an alternative embodiment of the invention.
Figure 23:
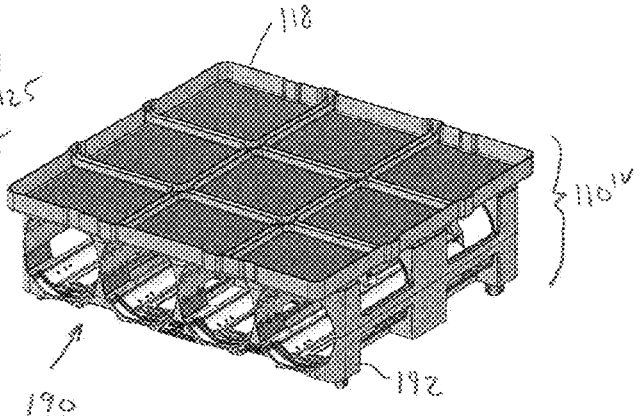
FIG. 23 is a perspective view of the base member of FIG. 22.

Referring to FIGS. 22-23, an alternative base member **110*iv* is illustrated. In this embodiment, instead of a pallet body, the tray member 118 is supported on a bottle rack 190. The bottle rack 190 includes a body 192 defining one or more bottle receiving tubes 194. The rack body 192 defines receiving holes 195 configured to receive posts 125 extending from the tray member 118 to secure the tray member 118 to the water rack 190. While a pallet body and bottle rack are illustrated supporting the tray member 118** to define the base member, it is recognized that other structures may alternatively be utilized.

As in the previous embodiments, the base member 110'" defines a plurality of dispenser lower cavities 128 while the top cap 140'" defines a plurality of upper cavities 148. Each of the upper cavities 148 is aligned with a respective lower cavity 128 such that a dispenser 10 is positioned with its lower portion in a lower cavity 128 and its upper portion in an upper cavity 148, thereby securing each dispenser in a position spaced from the outer perimeter and away from one another. If the optional wall assembly 170 is utilized, the wall assembly 170 will extend between the base member 110'" and the top cap 140'" to support the top cap 140'" and the dispensers 10 may be shorter than the distance therebetween (see FIGS. 18 and 19).

Figure 16:
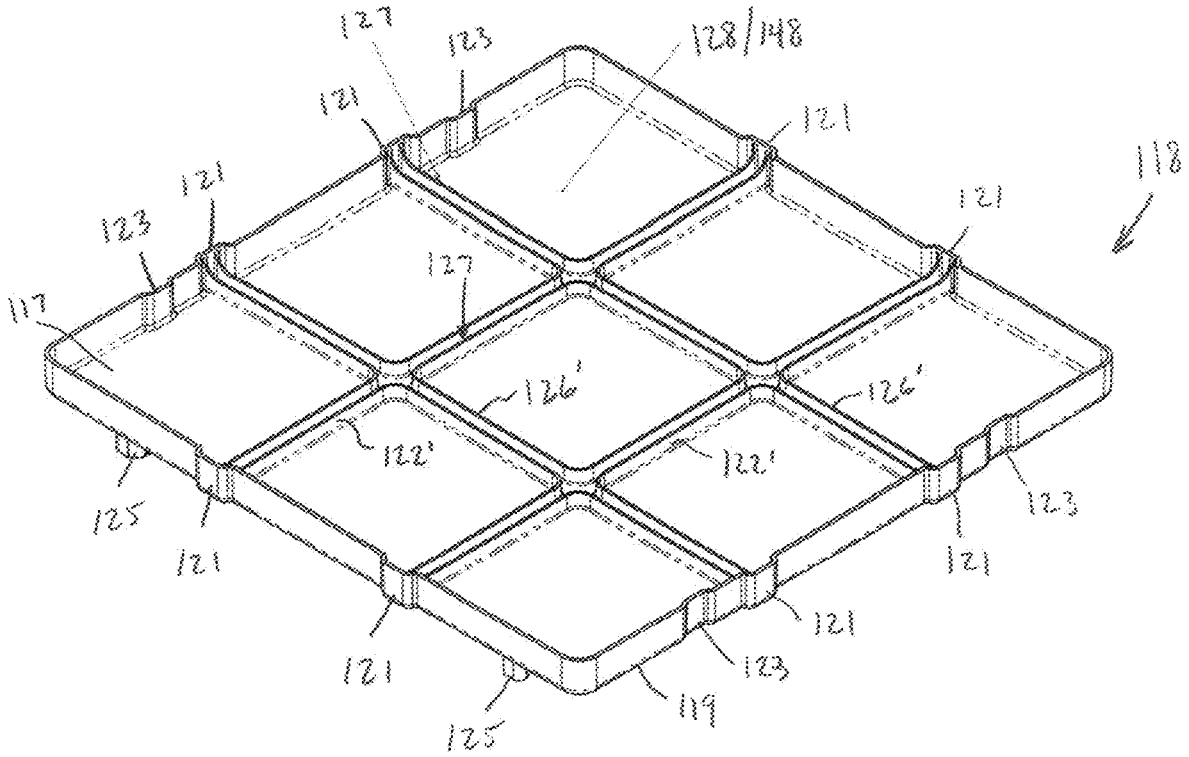
FIGS. 16 and 17 are top and bottom perspective views of the tray member of the dispenser transport pallet assembly of FIG. 14.
Figure 17:
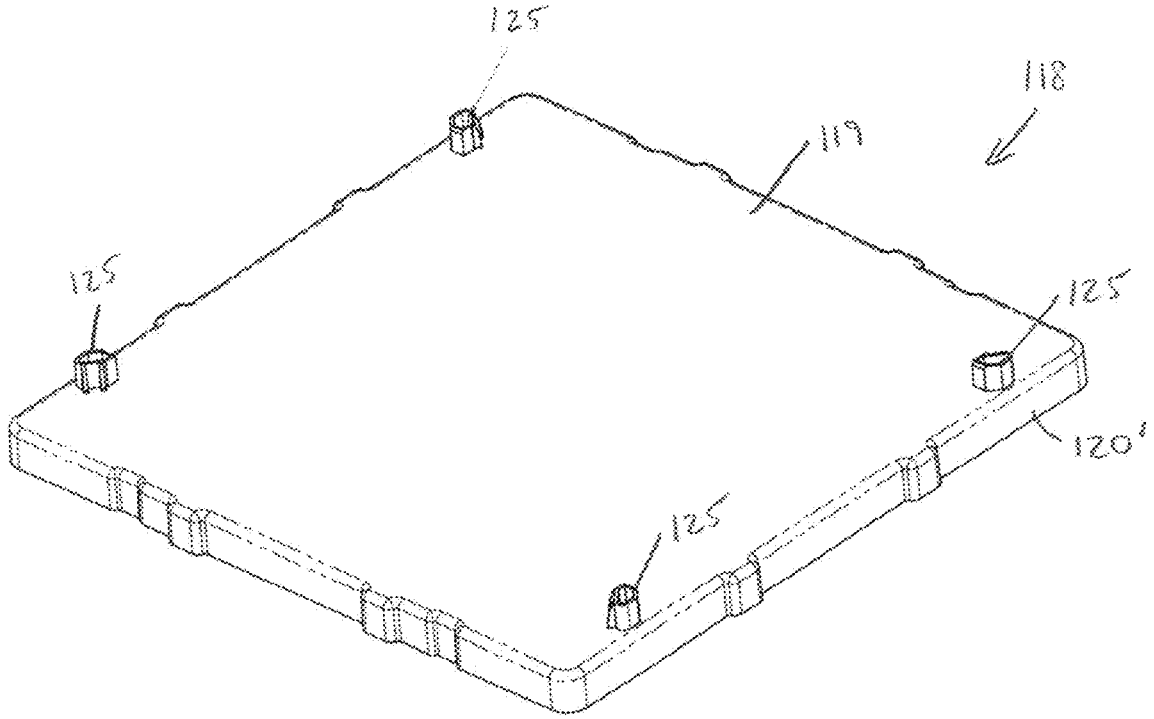

Referring to FIGS. 16 and 17, each tray member 118 defines an inner surface 117 and an outer surface 119. A rim 120' extends about the perimeter of the tray inner surface 117. The rim 120' may be continuous as illustrated or may extend at intervals along a portion of each cavity 128/148. In the illustrated embodiment, the rim 120' defines bump outs 121 and indents 123 which add rigidity to the rim 120'. To further define the cavities 128/148, longitudinal rails 122' extend from the tray inner surface 117 from front to back while lateral rails 126' extend from the tray inner surface 117 from side to side. The rails 122', 126' may be continuous as illustrated or may extend at intervals along a portion of each cavity 128/148. In the illustrated embodiment, the rails 122', 126' define nine cavities 128/148 in a 3×3 pattern. It is understood that the number and pattern of cavities may be modified.

In the present embodiment, each of the rails 122', 126' defines a slot 127 therealong configured to receive portions of the wall assembly 170 to retain the wall assembly 170 in position. The rails 122', 126' and slots 127 extend to bump outs 121 defined along the rim 120'. In this way, the rim 120' provides additional support and retention to the wall assembly 170. The outer surface 119 of the tray member 118 includes a plurality of posts 125 extending therefrom. The posts 125 are configured to be received in the post receiving holes 115 of the pallet body 112".

Figure 21:
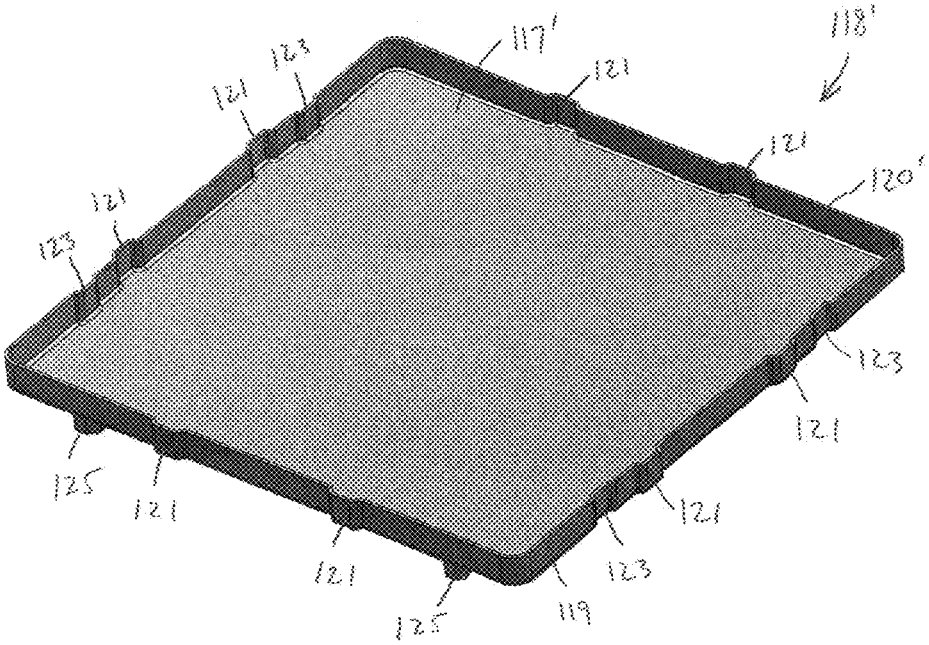
FIG. 21 is a perspective view of a tray member in accordance with an alternative embodiment of the invention.

With reference to FIG. 21, another embodiment of the tray member 118' is illustrated. In this embodiment, the inner surface 117' is defined as a planar surface without any rails. The bump outs 121 in the rim 120' receive and retain the wall assembly 170 and the wall assembly 170 alone defines cavities 180 (see FIGS. 14 and 15) for the dispensers 10. In other aspects, the tray member 118' is the same as in the previous embodiment.

Figure 15:
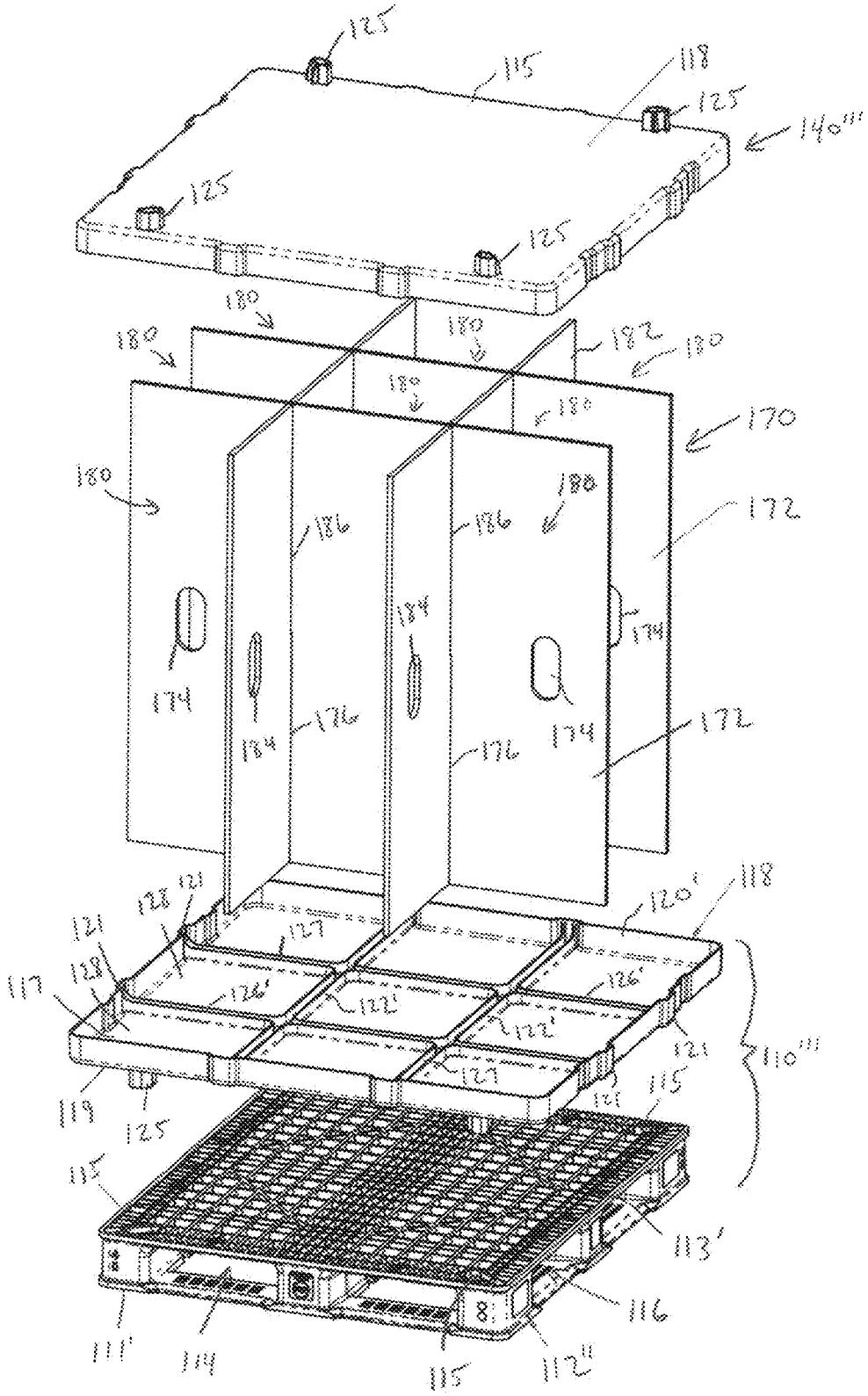
FIG. 15 is an exploded perspective view of the dispenser transport pallet assembly of FIG. 14.

Referring to FIGS. 14 and 15, an optional wall assembly 170 may be positioned between the base member 110'" and the top cap 140'". The wall assembly 170 includes a plurality of interconnected panels 172, 182, with the panels 172 extending from side to side of the tray member 118 and the panels 182 extending from front to back of the tray member 118. The interconnected panels 172, 182 form a grid which defines a plurality of dispenser receiving chambers 180, each of which aligns with a respective lower and upper cavity 128/148 pair. The panels 172, 182 may be interconnected utilizing various techniques. In the illustrated embodiment, the panels 172 have lower slots 176 and the panels 182 have upper slots 186 such that the panels 172, 182 may be slidingly interconnected with one another. One or more of the panels 172, 182 may be formed with handle openings 174, 184.

The wall assembly 170 is positioned such that it sits in the slots 127 defined by the rails 122', 126' and the bump outs 121. The wall assembly 170 provides support for the top cap 140'" and will provide further protection from impact, scratching and dirt of the dispensers 10. In the illustrated embodiment, the wall assembly panels 172, 182 have a linear configuration, however, the panels 172, 182 may have features which engage the dispensers 10. For example, the panels 172, 182 may have a corrugated configuration such that inside surfaces of the wavy structure contact and protect the dispensers. Additionally or alternatively, protective pads made from a lower durometer material (not shown) may be provided along the surfaces of the panels 172, 182.

Figure 18:
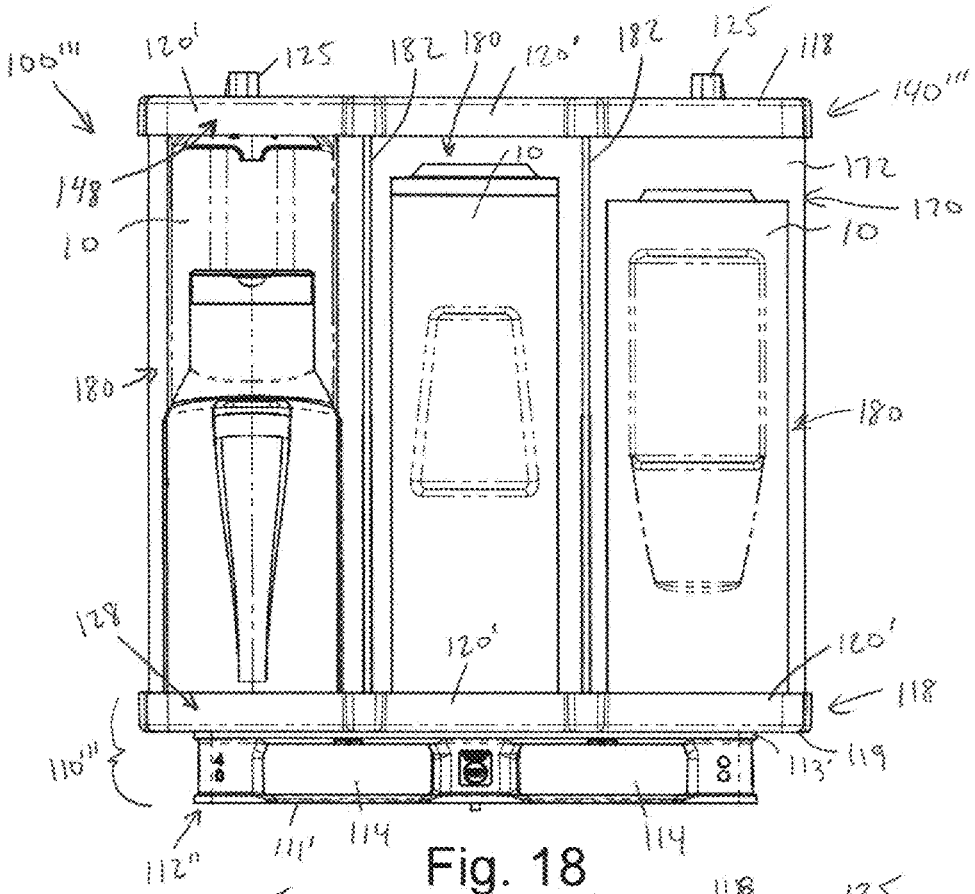
FIGS. 18 and 19 are front and side elevation views of the dispenser transport pallet assembly of FIG. 14.
Figure 19:
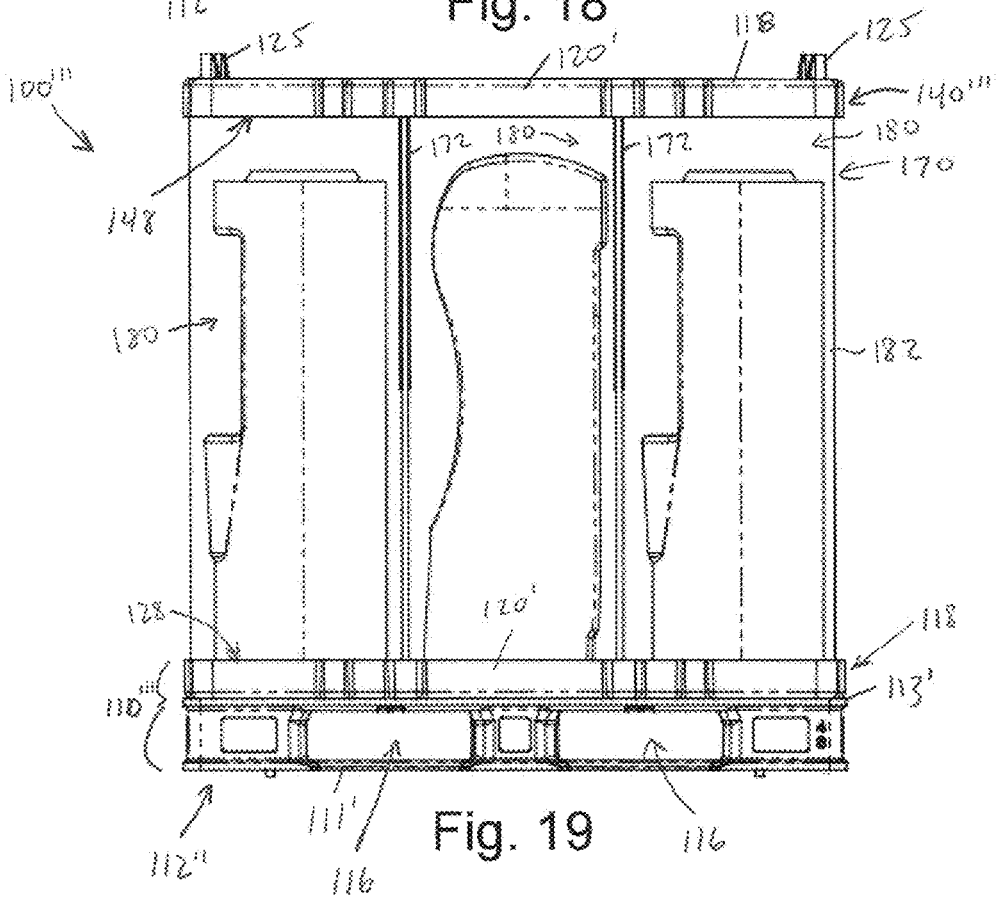
Figure 20:
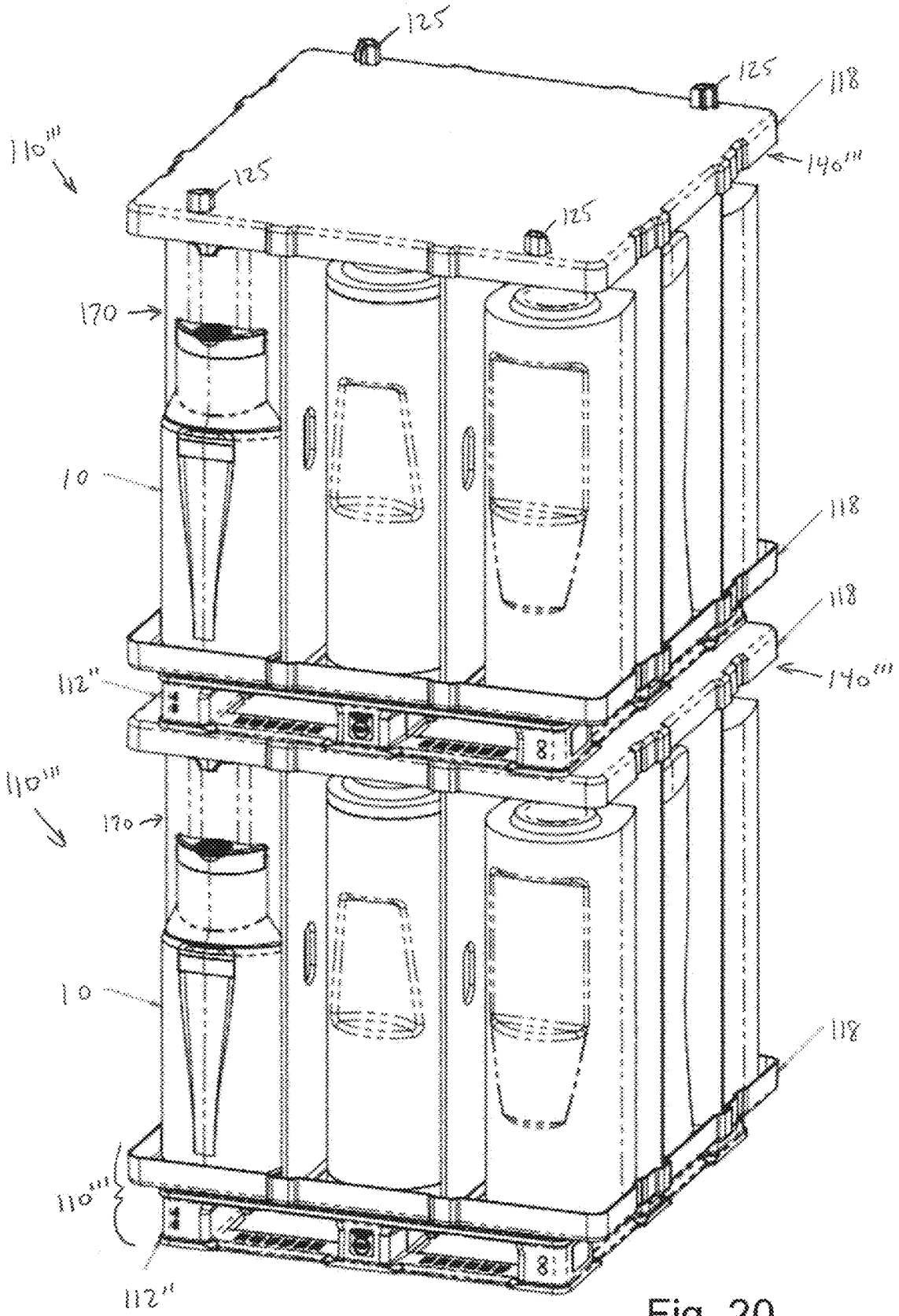
FIG. 20 is a perspective view illustrating stacking of two dispenser transport pallet assemblies of FIG. 14.

Referring to FIGS. 15, 18 and 19, an exemplary assembly of the dispenser transport pallet assembly 100'" will be described. As a first step, a tray member 118 is positioned on the pallet body 112" with the posts 125 extending into receiving holes 115 of the pallet body 112". The outer surface 119 of the tray member 118 rests on the upper surface 113 of the pallet body 112" to define the base member 110'". A plurality of dispensers 10 are positioned within the tray member 118, each within a respective cavity 128. The wall assembly 170 is then positioned about the dispensers 10 with the lower edges of the panels 172, 182 received in the slots 127. The wall assembly 170 may be lowered as an assembled unit or may be built about the dispensers 10, for example, with the panels 182 first positioned in the slots 127 defined by rails 122' and then the panels 172 slid into engagement with the panels 182 and into the slots 127 defined by the rails 126'. With the wall assembly 170 positioned, the tray member 118 defining the top cap 140'" is positioned onto the wall assembly 170 with the top portions of the panels 172, 182 received in the slots 127. As seen in FIGS. 18 and 19, the wall assembly 170 supports the top cap 140'" and the dispensers 10 may have a height less than that of the chambers 180. The posts 125 of the upper tray member 118 extend upward and facilitate stacking of the dispenser transport pallet assemblies 100'" as illustrated in FIG. 20. A pallet body 112" is positioned on the tray member 118 of the top cap 140'". A new tray member 118 is placed thereon and a second, stacked transport pallet assembly 100'" is formed thereon.

The dispenser transport pallet assembly in accordance with at least one embodiment of the invention will facilitate safe storage, transport and stacking of dispensers while greatly reducing the damage that occurs to the dispensers and reducing refurbishment costs. It may also free up warehousing space by allowing the dispensers to be stacked multiple layers high.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A dispenser transport pallet assembly for transporting one or more dispensers having a given configuration, the assembly comprising:

a base member including a tray member removably supported on a support structure, the tray member having an upper surface and a lower surface, the upper surface being opposed to the lower surface, the upper surface defining a support surface extending in a longitudinal direction and latitudinal direction with a perimeter extending about the support surface, the tray member including an upwardly extending rim along the perimeter of the support surface, and the lower surface defining a plurality of depending posts configured to be received in post receiving holes defined in the support structure;

a wall assembly supported on the support surface, the wall assembly including at least one longitudinally extending planar wall member and at least one latitudinally extending planar wall member, the longitudinally and latitudinally extending planar wall members intersecting todefine a plurality of dispenser chambers; and a top cap supported by the wall assembly, the top cap having a downwardly extending perimeter rim.

2. The dispenser transport pallet assembly according to claim 1 wherein the support structure is defined by a pallet body with at least one pair of fork receiving slots.

3. The dispenser transport pallet assembly according to claim 1 wherein the support structure is defined by a bottle rack.

4. The dispenser transport pallet assembly according to claim 1 wherein the tray member rim defines a plurality of slots extending perpendicular to the tray rim member and configured to receive the planar wall members.

5. The dispenser transport pallet assembly according to claim 4 wherein the top cap rim defines a plurality of slots extending perpendicular to the top cap rim and configured to receive the planar wall members.

6. The dispenser transport pallet assembly according to claim 4 wherein the tray member has a plurality of longitudinal and latitudinal rail members extending upward from the support surface, each of the rail members defines a slot therealong which aligns with respective slots in the rim.

7. The dispenser transport pallet assembly according to claim 4 wherein the tray member has a plurality of longitudinal and latitudinal rail members extending upward from the support surface, each of the rail members defines a slot therealong which aligns with respective slots in the rim.

8. The dispenser transport pallet assembly according to claim 1 wherein the wall assembly defines one or more handle openings.

* * * * *